United States Patent [19]

Dietrich

[11] 4,062,537

[45] Dec. 13, 1977

[54] APPARATUS FOR THE INFEED OF PRINTED PRODUCTS TO A STACKER

[75] Inventor: Felix Dietrich, Uster, Switzerland

[73] Assignee: Ferag AG, Hinwil, Switzerland

[21] Appl. No.: 722,888

[22] Filed: Sept. 13, 1976

[30] Foreign Application Priority Data

Oct. 8, 1975 Switzerland ..... 13063/75

[51] Int. Cl.[2] ..... B65H 29/50; B65H 29/04

[52] U.S. Cl. ..... 271/201; 214/6 G; 271/185; 271/205

[58] Field of Search ..... 271/201, 200, 205, 3.1, 271/184, 185, 173, 199, 202, 215; 214/6 G; 198/422

[56] References Cited

U.S. PATENT DOCUMENTS

| | | | |
|---|---|---|---|
| 1,958,133 | 5/1934 | Delany | 271/201 |
| 1,999,587 | 4/1935 | Davis | 271/205 X |
| 3,682,473 | 8/1972 | Kuyt | 271/201 X |
| 3,853,314 | 12/1974 | Anderson | 271/173 |

FOREIGN PATENT DOCUMENTS

| | | | |
|---|---|---|---|
| 552,330 | 6/1932 | Germany | 271/205 |

*Primary Examiner*—Bruce H. Stoner, Jr.
*Attorney, Agent, or Firm*—Werner W. Kleeman

[57] ABSTRACT

An apparatus for infeeding printed products or the like to a stacker, comprising an endless revolving conveyor having an outfeed portion which is elevationally adjustable and automatically accommodatable to the height of the formed stack. The outfeed portion is constituted by a loop of an essentially vertically traveling run of the conveyor, the loop is deflected out of the conveyor by means of guides which are arranged at a frame guided along the aforementioned run and displaceable by means of a lift drive. The lift drive can be switched-on and switched-off as a function of the response of a feeler provided at the frame and scanning the height of the stack.

11 Claims, 3 Drawing Figures

APPARATUS FOR THE INFEED OF PRINTED PRODUCTS TO A STACKER

BACKGROUND OF THE INVENTION

The present invention relates to a new and improved construction of apparatus for the infeed of printed products or the like to a stacker, comprising an endless revolving conveyor, the outfeed portion of which is elevationally adjustable and automatically accommodatable to the height of the formed stack. While the invention will be described by way of example in conjunction with the handling of printed products, it obviously can be used with other usually flat articles.

According to a prior art apparatus of this type the conveyor is constructed as a conveyor band or belt mounted in a rocker arm or balance which, in turn, is pivotable about a shaft arranged at the region of the infeed or inlet of the conveyor band. At the region of the end of the rocker arm or balance there is arranged the outfeed portion of the conveyor band and an arm which engages over the stack and bears upon the top side thereof, so that the height of the outfeed portion of the conveyor band automatically remains accommodated to the height of the growing stack. With this equipment, by changing the height of its delivery or outfeed location, there is taken into account the increasing height of the stack, in contrast to other equipment where the support surface of the stack is lowered as a function of its increasing size or growth.

Although with the heretofore known equipment this elevational adjustment of the outfeed portion is especially simple and, without any particular measures, also is automatically accommodated to different rates of growth of the stack, for practical reasons there is limited the elevational range which this outfeed portion is able to cover, and hence, there is equally limited the maximum attainable stack-height within the stacker. This is so because during rocking of the rocker arm or balance the outfeed portion of the conveyor band describes an arc and additionally, because the change in slope of the conveyor band, occurring during the course of the elevational adjustment, is limited to relatively narrow ranges.

Therefore, if there is to be infed articles to a stacker with the heretofore known equipment, and which stacker is constructed for forming particularly high stacks i.e. for instance having a height of 1 meter and more, then the length of the conveyor band and thus the rocker arm must be considerably increased in size, in order that the outfeed portion of the conveyor band can cover the elevational range of the stack without the band exceeding that limit of the slope which has been determined by experience. An extension of the rocker arm, however, apart from the increased technological expenditure, constitutes an increased spatial requirement at the place of erection of the equipment.

On the other hand, due to the considerably increased production capacity, for instance in the case of modern day rotary printing presses, there exists the tendency of providing stackers capable of handling increasingly greater stack heights. This development has been clearly documented, for instance, by the stackers disclosed in Swiss Pat. No. 566,928 and especially German patent publication No. 2,518,374. In reality, these stackers are designed such that they are capable of forming stacks which in their height far exceed heretofore conventionally formed stacks.

SUMMARY OF THE INVENTION

Hence, with the foregoing in mind it is a primary object of the present invention to provide a new and improved construction of apparatus for infeeding printed products or the like to a stacker in a manner not associated with the aforementioned drawbacks and limitations of the prior art constructions.

Another and more specific object of the present invention aims at the provision of a new and improved construction of apparatus of the previously mentioned type, wherein the outfeed portion of the conveyor is capable of following the growing stack practically independent of its final height, without there being required increased spatial area for the erection of the equipment.

Now in order to implement these and still further objects of the invention, which will become more readily apparent as the description proceeds, the apparatus of the present invention is manifested by the features that the outfeed portion is formed by a loop of an essentially vertically traveling run of a conveyor, the loop being deflected out of the conveyor by means of guides, these guides being guided by a frame guided along the aforementioned run and displaceable by a lift drive. The lift drive can be switched-on and switched-off as a function of the deflection of a feeler scanning or sensing the height of the stack and provided at the frame.

The feeler can be constituted by an arm articulated with the frame, the free end of which is intended to freely bear through the agency of a roller upon the top surface of the stack, and which is coupled with a transmitter or transducer detecting the pivoted position of such arm and controlling the lift drive. This transmitter can be, for instance, a potentiometer which, by means of its analogue signal drives a lift motor in the one or other rotational direction through the agency of a threshold value detector and a logic circuit, depending upon whether or not the potentiometer signal is greater or less than both of the threshold values.

The conveyor advantageously possesses grippers arranged in spaced relationship from one another in the conveying direction, these grippers are intended to engage with the lateral edges of the printed products. An especially advantageous construction of the conveyor is realized if it possesses two parallely revolving chains, each of which is equipped with such grippers.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
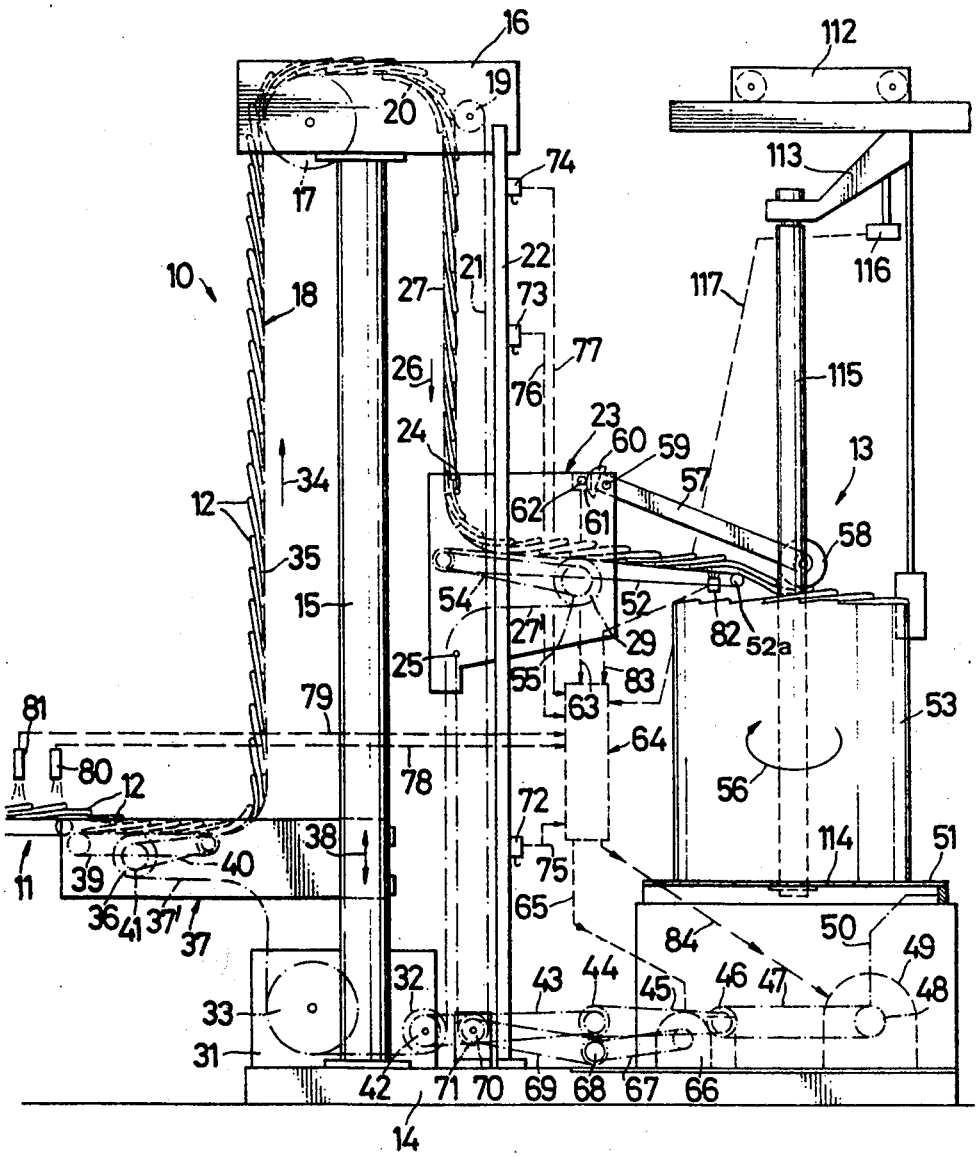
FIG. 1 is a simplified side view of an apparatus constructed according to the invention and arranged between the end of a conveyor band or belt and a stacker, also illustrating the printed products infed to the stacker.

Describing now the drawings, the exemplary illustrated embodiment of apparatus 10 serves for the infeed of articles, such as typically printed products 12 or the like arriving in an imbricated product stream from one end of a conveyor band or belt 11 or equivalent structure to a stacker 13 of the type which, for instance, has already been described in the previously mentioned German patent publication No. 2,518,374. At this stacker the infed imbricated printed products 12 are deposited upon a rotatable table 51, so that there is formed a "helical or spiral stack" 53 in which successive printed products only partially overlap. The thus formed stack has a substantially circular cylindrical envelope or outer surface and forms — even with heights far exceeding 1 meter — a pronounced inherently stable structure. It is to be understood that the stacker 13 itself does not however constitute subject matter of the present invention, since instead of the illustrated stacker there could equally well be employed for instance a stacker of the type wherein there is formed in a stacking chute a conventional, quadratic shaped, possibly crosswise-laid stack where successive products completely overlap.

Both the apparatus 10 as well as the stacker 13 are mounted upon a common base plate 14. At the base plate 14 there are mounted two sturdy columns, wherein in FIG. 1 there is only visible the column 15 closest to the observer. At their upper ends the columns 15 carry a box 16 or the like open at its top and bottom in which there are arranged the deflecting rolls or rollers 17 and guide rails 20 of an endless revolving conveyor 18 providing a conveying element as well as a deflecting roll 19 of a chain 21 (only indicated by the dash-dot lines) belonging to the lift or lifting drive. Both the conveyor 18 as well as the lift drive will be described in greater detail hereinafter.

Between the base plate 14 and the box 16 there are arranged a pair of vertical profile rails 22 in which there is displaceably guided a frame 23 at which there are anchored at locations 24 and 25 the ends of the chain 21. In the frame 23 the run 27 of the conveyor 18 which travels vertically downwards in the direction of the arrow 26 off the guide rails 20 is initially deflected by a curved rail portion 28 (FIG. 2) almost into a horizontal direction, then deflected by a deflecting wheel or roll 29 and by means of a further curved rail portion 30 (FIG. 2) is again turned back into the vertical direction. Consequently, there is deflected out of the conveyor run 27 an outwardly extending or protruding loop 27'. The run 27 next travels onto a drive wheel 32 located in a drive cabinet or box 31 located at the base plate 14, whereafter the conveyor 18, following a further deflection or deflecting roll 33, transforms into a conveyor run 35 which ascends in the direction of the arrow 34. Along the course of this run 35 the conveyor 18 again is deflected in the form of a loop 37' which can be accomplished by not particularly illustrated curved rail portions and a deflecting roll 36. This loop 37' of the ascending run 35 forms the infeed station 37 of the apparatus which, in turn, is elevationally adjustable by any suitable displacement or drive means in the sense of the doubleheaded arrow 38 and fixably secured to the columns 15. At the infeed station 37 the loop 37' has operatively associated therewith an infeed belt or band 39 which is driven by means of a chain 40 powered by a sprocket wheel 41 rigidly connected for rotation with the deflecting roll 36.

As already mentioned the conveyor 18 is driven by the drive wheel 32 which, in turn, is rigidly connected for rotation with a sprocket gear or wheel 42. A chain 43 leads from the sprocket wheel 42 to a first transmission or reduction gearing stage 44, from that location a chain 45 leads to a further transmission or reduction gearing stage 46, and from that location a chain 47 finally extends to the power take-off gear 48 of a drive motor 49. As indicated by the dash-dot or phantom lines 50, this drive motor 49 also drives the rotatable table 51 which is part of the stacker 13 and along therewith the stacker 13 itself.

The loop 27' of the descending run 27 of the conveyor 18 and which is equipped with grippers, as will be described more fully hereinafter, has associated therewith a transfer band 52. This transfer band or belt 52 receives the printed products 12 from the conveyor 18 and while freely supported moves such products past the terminal point or apex (deflecting roll 29) of the loop 27' until they are located over the stack 53 which is being formed at the rotatable table 51. The drive of the transfer band 52 is derived from a chain 54 and a sprocket wheel or gear 55 from which the power is removed. The sprocket gear 55 rotates together with the deflecting roll 29. The printed products 12 departing from the outfeed end or portion **52*a* of the transfer band or belt 52 arrive at the top of the stack 53 rotating in the direction of the arrow 56. Rolling upon the top of the stack 53 (externally of its axis of rotation) is a wheel 58 which is freely rotatably mounted at the end of a guide or arm 57 of a stack feeler arrangement. The other end of the guide 57 is articulated by means of a pivot pin 59 at the frame 23 and is equipped with a toothed segment 60. The toothed segment 60 meshes with a pinion 62 seated upon the shaft of a potentiometer 61** defining a transmitter for the feeler arrangement.

The inclined position of the guide or arm 57 therefore is a measure of the relative position of the top surface of the stack 53, upon which rolls the wheel 58, with respect to the frame 23 and thus also with respect to the transfer belt or band 52. The electrical signal tapped-off the potentiometer 61 is therefore also a measure of such relative position. The potentiometer 61 is connected via a schematically indicated measuring line or conductor 63 with a control circuit 64 for the apparatus, which in turn controls a lifting motor 66 by means of a conductor or line 65. This lifting or lift motor 66 drives, through the agency of a chain 67 or the like, a reduction gearing 68 and by means of a further chain 69 and a sprocket wheel 70 a drive sprocket wheel 71 about which there is trained the chain 21 belonging to the lift drive of the frame 23. Depending upon the direction of rotation of the lift motor 66 there is thus raised or lowered the frame 23 and thus also the loop 27' together with the transfer band 52, i.e. there is accommodated the momentary height of the stack 53 without changing the inclination of the transfer band 52. The conductor 65 also can be employed for engaging a coupling between the chain 27 and the motor 66 which in such case would be continuously in operation, in order to raise or lower the frame 23, depending upon requirements.

The elevational position of the frame 23 is also sensed by the limit switches 72, 73 and 74, which are adjustable and fixable in their elevational position and each of which is connected by the control lines or conductors 75, 76 and 77 to the control circuit 64. Further, control lines 78 and 79 extend to the control circuit 64, these control lines leading from a respective photodiode 80 and 81 or equivalent structure arranged at the end of the conveyor band 11 and detecting the presence of absence of printed products, as the case may be, whereas at the region of the end 52*a* of the transfer band 52 there is arranged a further photodiode 82 which through the agency of a control line or conductor 83 delivers to the control circuit 64 a signal which indicates the presence or absence, respectively, of the printed products. Finally, there extends from the control circuit 64 a further line or conductor 84 which serves for switching-on and switching-off the drive motor 49, i.e. for the drive of both the conveyor 18 and also the stacker 13. The construction of the control circuit 64 has not been described in detail herein since details thereof do not constitute subject matter of the invention, and particularly since anyone skilled in the art will be readily able to construct the same from the following description of the mode of operation of the apparatus without any problem, and additionally, because the design of such control circuit considerably depends upon the nature of the existing infeed and the supplied stacker.

Figure 2:
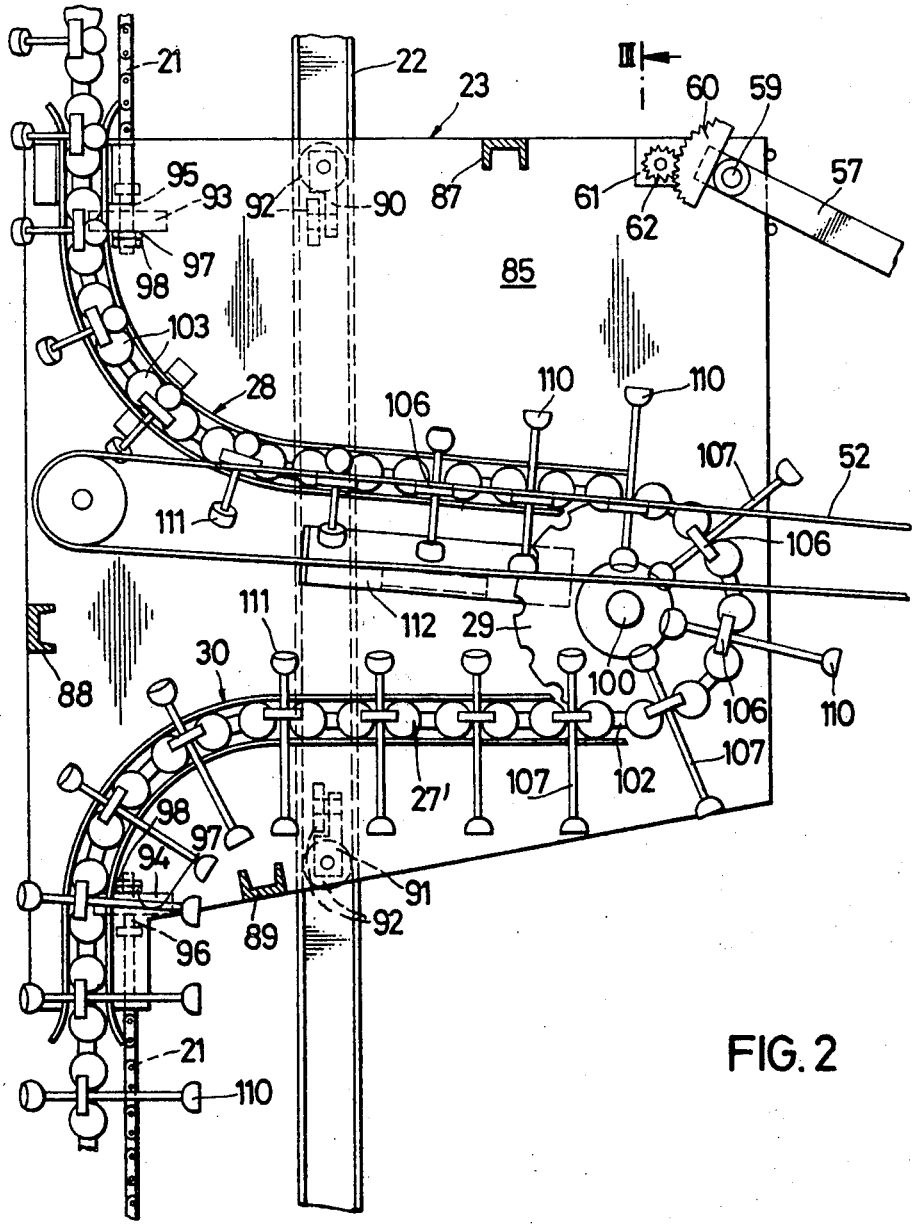
FIG. 2 is a simplified cross-sectional view, taken approximately along the line II—II of FIG. 3, through the elevationally displaceable frame together with the outfeed portion or section of a conveyor.
Figure 3:
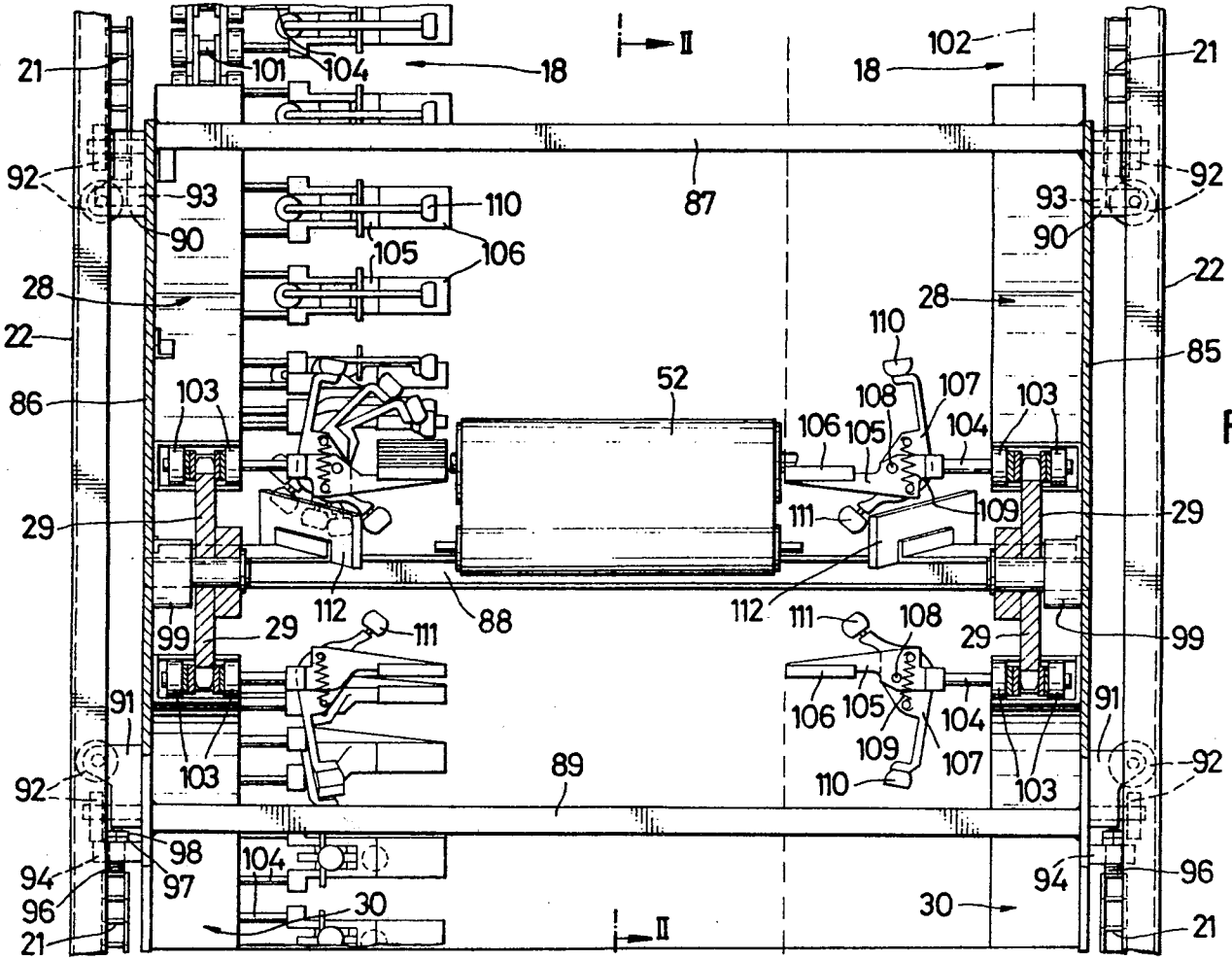
FIG. 3 is a cross-sectional view taken substantially along the line III—III of FIG. 2.

Initially, however, there will be described on the basis of FIGS. 2 and 3 details of the frame or frame means 23 and the conveyor 18. From the showing of FIG. 3 it will be recognized that the frame 23 has a substantially box-like structure containing two parallel side plates 85 and 86 which are fixedly interconnected by means of three lateral traverses or struts 87, 88 and 89. At the sides facing away from one another there are secured at each of the side plates 85 and 86 an upper and a lower bearing block 90 and 91 having freely rotatably guide rolls or rollers 92 which, in turn, engage in the profile rails 21 possessing a substantially U-profile or cross-sectional configuration. Additionally, to these sides of the plates 85 and 86 there are welded two respective angle members 93, 94 at which there are fixedly anchored by means of a clamping nut 97 and a counter or securing nut 98 the ends of the doubly-guided chain 21 equipped with the threaded bolts 95, 96. From the foregoing it will be apparent that the frame 23 is displaceable up and down in the profile rails 22 by means of the chain 21 in the manner of a lift or elevator cabin.

Continuing, at the confronting side of the side plates 85 and 86 there are secured in a mirror-symmetrical arrangement a respective curved rail 28 and 30 and a bearing journal 99 for the rotatable mounting of a pin 100 carrying the deflecting roll 29 constructed as a sprocket wheel and present in a twin construction.

The conveyor 18 possesses two endless substantially mutually parallel traveling chains 101 and 102, basically of the same construction, and for this reason there has only been illustrated in FIG. 3, and will merely be described in greater detail hereinafter the left-hand appearing chain 101 along with its important auxiliary components. Each of the chain links is equipped at both sides with freely rotatable rolls or rollers 103 engaging in the curved rails 28 and 30. The shafts 104 of the rolls 103 located furthest from the associated side plates 85 and 86 respectively, are extended or prolonged and each two of them carry an overhang arm or cantilever 105 (see the right-hand portion of FIG. 3), which is provided at its free end with a fixed gripper jaw 106. Additionally, at each of the overhang arms 105 there is hingedly connected by means of a pin 108 a substantially L-shaped pivotable lever 107. The pivotable lever 107 is exposed to the action of a tension spring 109 in such a manner that it can assume two stable pivoted positions. The one end of the pivotable lever 107 carries a clamping roll or roller 110 co-operating as a movable gripper jaw with a stationary gripper jaw 106, whereas at the other end of the pivotable lever 107 there is freely rotatably mounted a spherical zone-shaped follower element 111. Follower element 111 coacts with cams or brackets or the like arranged along the course of travel of the chains 101, 102, so that the pivotable lever 107 pivots into the one or the other of its stable pivotable positions. In FIGS. 2 and 3 there have been shown the brackets or cams 112 which force the follower element 111 away from the associated chain shortly prior to the time that such travels onto the deflecting roll 29, so that the clamping rolls 110 pivot into their open position and the previously fixedly clamped printed products — which have not been particularly illustrated in FIGS. 2 and 3 — are delivered to the transfer band or belt 52 which travels between both of the chains 101 and 102 and the overhang arms 105 carried thereby.

From what has been described it will be seen that even with the chains 101 and 102 in motion the entire frame 23 can be readily raised and lowered, as desired. The only effect upon the passage of the conveyor 18 through the frame 23 is that its throughpassage speed must be raised or lowered, respectively, with regard to this frame by the lifting- or lowering speed. Since, however, in any event the travel speed of the chains 101 and 102 is much higher than the rate of growth of the stack 53, which as has been explained corresponds to the average lift speed of the frame 23, such increase of the relative throughpass speed is negligible.

On the basis of FIG. 1 there will now be described the mode of operation of the illustrated apparatus. It is assumed that no printed products have yet been received from the conveyor bank or belt 11. The photodiode 80 reports the "absence" of the printed products and inhibits the control circuit 64 from switching-on the drive by means of the drive motor 49. The frame 23 is in its highest position detected by the boundary or limit switch 74.

By means of the lifting device 113 which can travel upon a trolley 112 a central tube 115, equipped at its lower end with a support disc or plate 114, is centrally coupled with the rotatable table 51. Then, the lifting device 113 is lowered and moved away by means of the trolley 112, which operation is detected by a limit or boundary switch 116 connected through the agency of a control line 117 with the control circuit 64. The response of the limit switch 116 causes switching-on of the motor 66 in that direction which lowers the frame 23. The latter is lowered until reaching its lowermost position determined by the limit switch 72. Up to this point the potentiometer 61 in this circuit 64 has been shunted and therefore is ineffectual. Response of the limit switch 72 activates the potentiometer 61 and the photodiode 81, switchesoff the motor 66 and reverses the polarity thereof. As soon as the photodiode 81 delivers the information "presence" of products, then the drive is turned on by means of the drive motor 49 and thus the conveyor 18 and the stacker 13 are driven. There begins to form a stack 53 and as a function of the growth thereof the frame 23 is raised, as previously described. If during stacking there occurs an interruption in the infeed of printed products, then this is detected by the photodiode 80 which immediately suppreses the drive by the motor 49. The printed products which are so to speak "under way" are not further conveyed, and equally further stacking is discontinued. As soon as printed products are again infed this is detected by the photodiode 81 and thus the drive by means of the motor 49 is again switched-on. By virtue of these measures an interruption in the infeed of printed products does not have any effect upon the formation of the stack 53. As soon as the stack 53 has reached a height which causes the frame 23 to activate the limit switch 73, then with the aid of not particularly illustrated means, for instance by a branch or switch in the conveyor band 11, there is suppressed the infeed of printed products to the equipment, the photodiodes 80 and 81 are deactivated and the photodiode 82 activated. The motor 49 controlled by this photodiode 82 remains switched-on, equally the potentiometer 61 which controls the lift movement of the frame 23. As soon as the last printed product has departed from the outfeed portion 52*a* of the transfer band 52, the photodiode 82 reports "absence of printed products", with the result that there is switched-off the drive by the motor 49, the potentiometer 61 is shunted and the motor 66 is turned-on so as to be active in the lift direction.

Consequently, the frame 23 is raised until response of the limit switch 74, i.e. the starting position is again established. Now, by means of the lifting device 113 the stack 53, which at the region of its lengthwise axis is supported at the support plate or disc 114, is raised from the rotatable table 51 by means of the central tube 115 surrounded by the stack 53 and, for instance, deposited upon a palette or the like. Upon insertion of a new central tube at the rotatable table it is possible, in the described manner, to begin with the formation of a new stack.

The described operations, on the one hand, define the control circuit 64 but, on the other hand, are to be specifically construed and understood to be exemplary. Thus, for instance it is not absolutely mandatory after finishing a stack to permit the apparatus 10 to "idle". The limit switch 73 also can be connected such that it directly interrupts the drive derived from the motor 49 and causes lifting of the frame 23 to the limit switch 74. In this way there can be shortened the time during which there is interrupted the infeed of printed products by the conveyor band 11. With this mode of operation a precondition then of course is that the same printed products are provided for successive stacks.

As already mentioned the height of the stack 53 can be selected, for instance, by adjusting the limit switch 73. On the other hand, the height of the stack can be controlled indirectly also by counting the infed printed products by means of a counter suitable for this purpose which is likewise connected with the control circuit. Such counter, in this case, assumes to a certain extent the role of the limit switch 73.

Also the described apparatus can be accommodated without any great difficulty to the prevailing conditions existing for the supply of printed products. This is possible for instance in that there can be adjusted the height of the infeed station 37. Such adjustment does not require any additional resetting work. It is in fact possible by appropriately arranging the brackets or cams which again bring the pivotable levers 107 into their closed position and which for the described exemplarly embodiment logically are arranged at the region of the infeed band 39, to construct the path of the conveyor 18, extending between the deflecting roll 17 and the guide rail 20, as an infeed station which then however is no longer adjustable in elevation unless further measures are provided.

Finally, the apparatus also can be simplified in its construction in that there can be dispensed with gripper components at one of both associated chains 101, 102. This simpler embodiment presupposes that a certain stiffness or rigidity is possessed by the printed products, and consequently is associated with an increased dependence upon the shape or format of such products because the printed products, when moving through the apparatus, only can be seized at one of their lateral edges.

While there are shown and described present preferred embodiments of the invention, it is to be distinctly understood that the invention is not limited thereto, but may be otherwise variously embodied and practiced within the scope of the following claims. Accordingly,

What is claimed is:

1. An apparatus for delivering an imbricated stream of printed products to a stacker, comprising an infeed station, an outfeed station and a conveyor extending between said stations, said conveyor being provided with spaced grippers for laterally gripping the imbricated stream of printed products, said conveyor comprising a substantially vertically travelling run, said outfeed station comprising means for deflecting a loop out of said run, said loop having a leg terminating at an apex of said loop, opening means positioned in the range of said leg for opening the grippers, a conveyor belt running parallel to said leg for receiving the imbricated stream of printed products thereon and having an outfeed portion extending past said apex of said loop, means for driving said conveyor and said conveyor belt in synchronism, said guide means, opening means and said conveyor belt being mounted in a frame, a lift drive for displacing and guiding said frame along said vertically travelling run, said frame being provided with a feeler for scanning the height of the stack and for switching-on and switching-off said lift drive as a function of the response of said feeler.

2. The apparatus as defined in claim 1, wherein the feeler comprises an arm, means pivotably connecting the arm at the frame, the arm having a free end bearing against the top surface of the stack, a transmitter for detecting the pivotal position of the arm and for controlling the lift drive, and means for operatively connecting said arm with said transmitter.

3. The apparatus as defined in claim 2, wherein the transmitter comprises a potentiometer.

4. The apparatus as defined in claim 1, wherein the conveyor possesses a predetermined conveying direction, said gripper being arranged in spaced relationship from one another in the conveying direction of the conveyor, said grippers serving to sieze the lateral edges of the printed products.

5. The apparatus as defined in claim 4, wherein the conveyor comprises two substantially parallel revolving chains, each of said chains being equipped with said grippers.

6. The apparatus as defined in claim 4, wherein each gripper comprises a stationary clamping jaw and a movable clamping jaw, spring means for pivoting the movable clamping jaw between a stable open position and a stable closed position, a follower element, cam means mounted in said frame, the follower element co-operating with said stationary cam means, the movable clamping jaw being connected with the follower element.

7. The apparatus as defined in claim 4, including means for driving the vertically traveling run of the conveyor from the top towards the bottom.

8. An apparatus for infeeding printed products to a stacker comprising an endless revolving conveyor having an outfeed portion, the conveyor comprising a conveying element having a run which travels essentially vertically, guide means for deflecting a loop out of the vertically travelling run of the conveying element, said loop defining said outfeed portion of the conveyor, means for elevationally adjusting said outfeed portion and automatically accommodating the same to the height of the formed stack, said adjusting means comprising a frame, a lift drive for displacing the frame and guiding the same along said run of the conveying element, said guide means being arranged at said frame, a feeler provided at the frame for scanning the height of the stack and switching-on and switching-off the lift drive as a function of the response of the feeler, said conveyor possessing a predetermined conveying direction, grippers provided for said conveyor and arranged in spaced relationship from one another in the conveying direction of the conveyor, said grippers serving to seize the lateral edges of the printed products, said conveyor comprising two substantially parallel revolving chains, each of said chains being equipped with said grippers, said loop having a leg terminating at an apex of the loop, a conveyor band extending substantially parallel to said leg of said loop, said conveyor band being arranged at the region of the loop and between said chains, said conveyor band having an outfeed portion extending past said apex of said loop.

9. The apparatus as defined in claim 8, further including curved rail means arranged at the frame for guiding the chains at the region of the leg of the loop, and sprocket gear means freely rotatably mounted at the frame for guiding the chains at the region of the apex of the loop.

10. The apparatus as defined in claim 1, further including rail means arranged substantially parallel to the vertically traveling run, the frame being guided in said rail means.

11. The apparatus as defined in claim 10, wherein the lift drive comprises a chain anchored at the frame, rolls arranged at opposite end regions of the rail means, said chain being guided about said rolls, a drive unit which can be switched-on and switched-off by means of said feeler for driving at least one of said rolls.

* * * * *